US008308023B2

(12) United States Patent
Gelardi et al.

(10) Patent No.: US 8,308,023 B2
(45) Date of Patent: Nov. 13, 2012

(54) PRODUCT DISPENSING SYSTEM WITH DIRECTIONAL FLEXING CONTAINER

(75) Inventors: John Gelardi, Midlothian, VA (US); Laurel Thomas, Richmond, VA (US); Ryan Bailey, Richmond, VA (US); Steve Simmons, Chesterfield, VA (US)

(73) Assignee: MeadWestvaco Corporation, Richmond, VA (US)

( * ) Notice: Subject to any disclaimer, the term of this patent is extended or adjusted under 35 U.S.C. 154(b) by 129 days.

(21) Appl. No.: 13/032,759

(22) Filed: Feb. 23, 2011

(65) Prior Publication Data

US 2012/0211510 A1 Aug. 23, 2012

(51) Int. Cl.
*B65G 65/23* (2006.01)

(52) U.S. Cl. ..... 221/31; 414/412; 83/856; 83/946; 229/122.2; 229/204

(58) Field of Classification Search ..... 53/381.2; 221/31; 83/946, 856, 17, 20; 414/412; 229/204, 229/122.2; 206/239; 222/81
See application file for complete search history.

(56) References Cited

U.S. PATENT DOCUMENTS

| | | | | |
|---|---|---|---|---|
| 902,347 | A | 10/1908 | Tillinghast | |
| 1,291,420 | A | 1/1919 | Cough | |
| 1,383,318 | A | 7/1921 | McCormick | |
| 1,393,964 | A | 10/1921 | Potts et al. | |
| 1,753,957 | A | 4/1930 | Washburn | |
| 1,824,937 | A | 9/1931 | Trouth | |
| 1,858,199 | A * | 5/1932 | De Maziroff | 206/239 |
| 1,898,056 | A | 2/1933 | Johnson | |
| 1,919,907 | A | 7/1933 | Robinson | |
| 1,932,225 | A | 10/1933 | Minter | |
| 1,941,458 | A | 2/1934 | Bens | |
| 1,985,739 | A | 12/1934 | Murray | |
| 2,078,599 | A | 4/1937 | McCauley | |
| 2,110,194 | A | 3/1938 | Blier | |
| 2,263,353 | A | 11/1941 | Eidam | |
| 2,291,187 | A | 7/1942 | Johnson | |
| 2,382,191 | A | 7/1944 | Weichselbaum | |
| 2,536,421 | A | 2/1951 | Burhans | |
| 2,573,381 | A | 10/1951 | Arnold | |
| 2,574,087 | A | 11/1951 | Burhans | |
| 2,595,122 | A | 4/1952 | Burhans | |

(Continued)

FOREIGN PATENT DOCUMENTS

DE 2655496 6/1978

(Continued)

OTHER PUBLICATIONS

International Search Report and Written Opinion issued in PCT/US2010/1057020 (Mar. 8, 2011).

(Continued)

*Primary Examiner* — Kenneth E. Peterson
(74) *Attorney, Agent, or Firm* — Walters & Wasylyna, LLC

(57) ABSTRACT

A product dispensing system including a container having multiple walls that define an internal volume, at least one of the walls including a pre-formed flex line, and a dispenser including a frame having a front end and a rear end, the frame including a stop positioned proximate the rear end and a support deck extending between the front end and the rear end, and an opening tool positioned to open the container as the container is moved along the support deck into engagement with the stop, wherein the engagement between the stop and the container effects a flexing of the container along the pre-formed flex line.

13 Claims, 8 Drawing Sheets

U.S. PATENT DOCUMENTS

| | | | |
|---|---|---|---|
| 2,784,871 | A | 3/1957 | Gabrielsen |
| 2,795,845 | A | 6/1957 | Shimer |
| 2,818,978 | A | 1/1958 | Post |
| 2,826,471 | A | 3/1958 | Fonda |
| 2,831,591 | A | 4/1958 | Morton |
| 2,888,145 | A | 5/1959 | Knott et al. |
| 2,915,932 | A | 12/1959 | Gross |
| 2,919,488 | A | 1/1960 | Brownlee |
| 2,996,344 | A | 8/1961 | Garman |
| 3,018,149 | A | 1/1962 | Parker |
| 3,055,293 | A | 9/1962 | Lariccia |
| 3,066,827 | A | 12/1962 | Pryor |
| 3,137,068 | A | 6/1964 | Quigley |
| D198,888 | S | 8/1964 | Heselov |
| 3,178,242 | A | 4/1965 | Ellis et al. |
| 3,184,104 | A | 5/1965 | De Domenico et al. |
| 3,203,554 | A | 8/1965 | Pendergrast et al. |
| 3,204,335 | A | 9/1965 | Hughes |
| 3,288,544 | A | 11/1966 | Knecht |
| 3,300,115 | A | 1/1967 | Schauer |
| 3,304,141 | A | 2/1967 | Rogers |
| 3,318,455 | A | 5/1967 | Takahashi |
| 3,335,940 | A | 8/1967 | Dykes |
| 3,340,790 | A | 9/1967 | Simjian |
| 3,348,738 | A | 10/1967 | Hertlein |
| 3,392,901 | A | 7/1968 | Krzyzanowski |
| 3,393,808 | A | 7/1968 | Chirchill |
| 3,501,016 | A | 3/1970 | Eaton |
| 3,763,557 | A | 10/1973 | Sewell |
| 3,784,022 | A | 1/1974 | Beesley, Jr. |
| 3,922,778 | A | 12/1975 | Aalpoel |
| 3,923,159 | A | 12/1975 | Taylor et al. |
| 3,972,454 | A | 8/1976 | Croley |
| 4,105,126 | A | 8/1978 | Deffner et al. |
| 4,205,440 | A | 6/1980 | Morgan |
| 4,260,072 | A | 4/1981 | Quasarano |
| 4,318,458 | A | 3/1982 | Ritsema |
| 4,382,526 | A | 5/1983 | Stone |
| 4,396,143 | A | 8/1983 | Killy |
| 4,435,026 | A | 3/1984 | Johnson |
| 4,467,524 | A | 8/1984 | Ruff et al. |
| 4,576,272 | A | 3/1986 | Morgan, Jr. |
| 4,598,828 | A | 7/1986 | Young et al. |
| 4,729,480 | A | 3/1988 | Groover et al. |
| 4,744,489 | A | 5/1988 | Binder et al. |
| 4,834,263 | A | 5/1989 | Becze |
| 4,869,395 | A | 9/1989 | Rubbmark |
| 4,911,309 | A | 3/1990 | Stefan |
| 4,915,571 | A | 4/1990 | Toshihiko et al. |
| 4,923,070 | A | 5/1990 | Jackle et al. |
| 4,997,106 | A | 3/1991 | Rockola |
| 4,998,628 | A | 3/1991 | Ross |
| 5,033,348 | A | 7/1991 | Walsh |
| 5,080,256 | A | 1/1992 | Rockola |
| 5,101,703 | A | 4/1992 | Tanaka et al. |
| 5,167,345 | A | 12/1992 | Bleeker |
| 5,190,155 | A | 3/1993 | Grunwald |
| 5,251,972 | A | 10/1993 | Zurawin |
| 5,289,943 | A | 3/1994 | Powell |
| 5,314,078 | A | 5/1994 | Morikiyo et al. |
| 5,328,258 | A | 7/1994 | Scalise |
| 5,356,033 | A | 10/1994 | Delaney |
| 5,372,278 | A | 12/1994 | Leight |
| 5,390,821 | A | 2/1995 | Markel |
| 5,396,997 | A | 3/1995 | Johnson |
| D363,174 | S | 10/1995 | Fletcher, Sr. |
| 5,462,198 | A | 10/1995 | Schwimmer |
| 5,529,207 | A | 6/1996 | Oden et al. |
| 5,638,988 | A | 6/1997 | Rogers |
| 5,685,664 | A | 11/1997 | Parham et al. |
| 5,740,610 | A | 4/1998 | Ayer et al. |
| 5,788,117 | A | 8/1998 | Zimmanck |
| 5,791,048 | A | 8/1998 | Bodnar et al. |
| 5,836,478 | A | 11/1998 | Weiss |
| 5,878,862 | A | 3/1999 | Dewsnap |
| 5,894,942 | A | 4/1999 | Miyashita et al. |
| 5,924,573 | A | 7/1999 | Piraneo et al. |
| 5,992,286 | A | 11/1999 | Boole |
| 5,992,652 | A | 11/1999 | Springs |
| 6,186,345 | B1 | 2/2001 | Robertson |
| 6,199,720 | B1 | 3/2001 | Rudick et al. |
| 6,206,237 | B1 | 3/2001 | Dillon et al. |
| 6,253,930 | B1 | 7/2001 | Freidus et al. |
| 6,267,258 | B1 | 7/2001 | Wilkerson et al. |
| 6,393,799 | B2 | 5/2002 | Jenkins et al. |
| 6,637,604 | B1 | 10/2003 | Jay |
| 6,802,433 | B2 | 10/2004 | Leykin |
| 6,991,116 | B2 | 1/2006 | Johnson et al. |
| 7,207,447 | B2 | 4/2007 | Medcalf et al. |
| 7,303,095 | B2 | 12/2007 | Nagelski et al. |
| 7,546,973 | B2 | 6/2009 | Budz et al. |
| 7,584,854 | B2 | 9/2009 | Chandaria |
| D604,972 | S | 12/2009 | Henry et al. |
| 7,665,618 | B2 | 2/2010 | Jay et al. |
| 7,681,745 | B2 | 3/2010 | Richter |
| 7,810,672 | B1 | 10/2010 | Mason et al. |
| 7,823,733 | B2 | 11/2010 | Futori |
| 7,850,015 | B1 | 12/2010 | Mason |
| 7,913,860 | B2 | 3/2011 | Merl |
| 7,918,365 | B2 | 4/2011 | White et al. |
| 7,922,437 | B1 | 4/2011 | Loftin et al. |
| 8,028,855 | B2 | 10/2011 | White et al. |
| 2002/0043509 | A1 | 4/2002 | Lajeunesse et al. |
| 2004/0011751 | A1 | 1/2004 | Johnson et al. |
| 2004/0079760 | A1 | 4/2004 | Rink |
| 2004/0262326 | A1 | 12/2004 | Christensen |
| 2005/0092644 | A1 | 5/2005 | Cafferata |
| 2005/0127015 | A1 | 6/2005 | Medcalf et al. |
| 2005/0207877 | A1 | 9/2005 | Haverdink et al. |
| 2006/0081692 | A1 | 4/2006 | Stewart et al. |
| 2006/0237384 | A1 | 10/2006 | Neumann et al. |
| 2006/0278591 | A1 | 12/2006 | Tippets et al. |
| 2007/0194037 | A1 | 8/2007 | Close |
| 2008/0245813 | A1 | 10/2008 | Johnson et al. |
| 2009/0212066 | A1 | 8/2009 | Bauer |
| 2009/0266776 | A1 | 10/2009 | Johnson |
| 2009/0277853 | A1 | 11/2009 | Bauer |
| 2010/0032391 | A1 | 2/2010 | Schneider et al. |
| 2011/0121010 | A1 | 5/2011 | Loftin et al. |
| 2011/0121011 | A1 | 5/2011 | Gelardi et al. |

FOREIGN PATENT DOCUMENTS

| | | | |
|---|---|---|---|
| DE | 29808673 | | 11/1998 |
| DE | 19808162 | | 9/1999 |
| DE | 20111307 | | 10/2001 |
| DE | 202007012114 | | 11/2007 |
| GB | 2190906 | | 12/1987 |
| GB | 2303624 | | 2/1997 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 092822537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |

| | | | |
|---|---|---|---|
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011109350 | | 9/2011 |

OTHER PUBLICATIONS

International Search Report and Written Opinion issued in PCT/US2010/057221 (Mar. 4, 2011).

International Search Report and Written Opinion issued in PCT/US2012/020619, Apr. 11, 2012.

* cited by examiner

PRODUCT DISPENSING SYSTEM WITH DIRECTIONAL FLEXING CONTAINER

FIELD

This application relates to the dispensing of products from packaging containers and, more particularly, to packaging containers configured to cooperate with product dispensers to dispense products.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model are being developed in an effort to improve operating efficiency. For example, U.S. patent application Ser. No. 12/777,444 filed on May 11, 2010, the entire contents of which are incorporated herein by reference, discloses a new system for dispensing and displaying products packaged in a container. Specifically, the product dispensing system includes a dispenser having a support structure, a product display area and an opening tool. The dispenser may be positioned on a retailer's shelf and loaded with product simply by placing a container comprising multiple units of product onto the support structure of the dispenser. As the container is being placed onto the support structure, the opening tool of the dispenser opens the container in such a manner that product rolls from the container and down to the product display area of the dispenser under the force of gravity.

Unfortunately, such product dispensing systems may become jammed when a single product fails to properly exit the container. A jam may prevent products from moving to the product display area.

Accordingly, those skilled in the art continue with research and development efforts directed to apparatus and systems for dispensing products from packaging containers.

SUMMARY

In one aspect, the disclosed product dispensing system may include a container having a plurality of walls that define an internal volume, at least one of the walls including a pre-formed flex line, and a dispenser including a frame having a front end and a rear end, the frame including a stop positioned proximate the rear end and a support deck extending between the front end and the rear end, and an opening tool positioned to open the container as the container is moved along the support deck toward the stop, wherein the container flexes along the pre-formed flex line when the container engages the stop.

In another aspect, the disclosed product dispensing system may include a container including opposed base and upper walls, opposed first and second side walls and opposed front and rear walls, the walls defining an internal volume, wherein the first side wall includes a first pre-formed flex line proximate the rear wall, and wherein the second side wall includes a second pre-formed flex line proximate the rear wall, a plurality of products received in the internal volume, and a dispenser including a frame having a front end and a rear end, the frame including a stop positioned proximate the rear end, an upper support deck extending between the front end and the rear end, and a lower support deck extending between the front end and the rear end, the lower support deck defining a product display area proximate the front end, and an opening tool positioned to form an opening in the base wall proximate the rear wall as the container is moved along the upper support deck toward the stop, wherein engagement between the stop and the container effects a flexing of the container along the first and second pre-formed flex lines, thereby allowing the products to be at least partially dispensed from the container, through the opening, and to the product display area.

In yet another aspect, the disclosed container may include opposed base and upper walls, opposed first and second side walls, and opposed front and rear walls, the walls defining an internal volume, wherein the first side wall includes a first pre-formed flex line proximate the rear wall, and wherein the second side wall includes a second pre-formed flex line proximate the rear wall, and wherein the first and second side walls outwardly flex along the first and second pre-formed flex lines, respectively, when a longitudinal force is applied to the rear wall.

Other aspects of the disclosed product dispensing system with directional flexing and associated container will become apparent from the following detailed description, the accompanying drawings and the appended claims.

DETAILED DESCRIPTION

Figure 1:
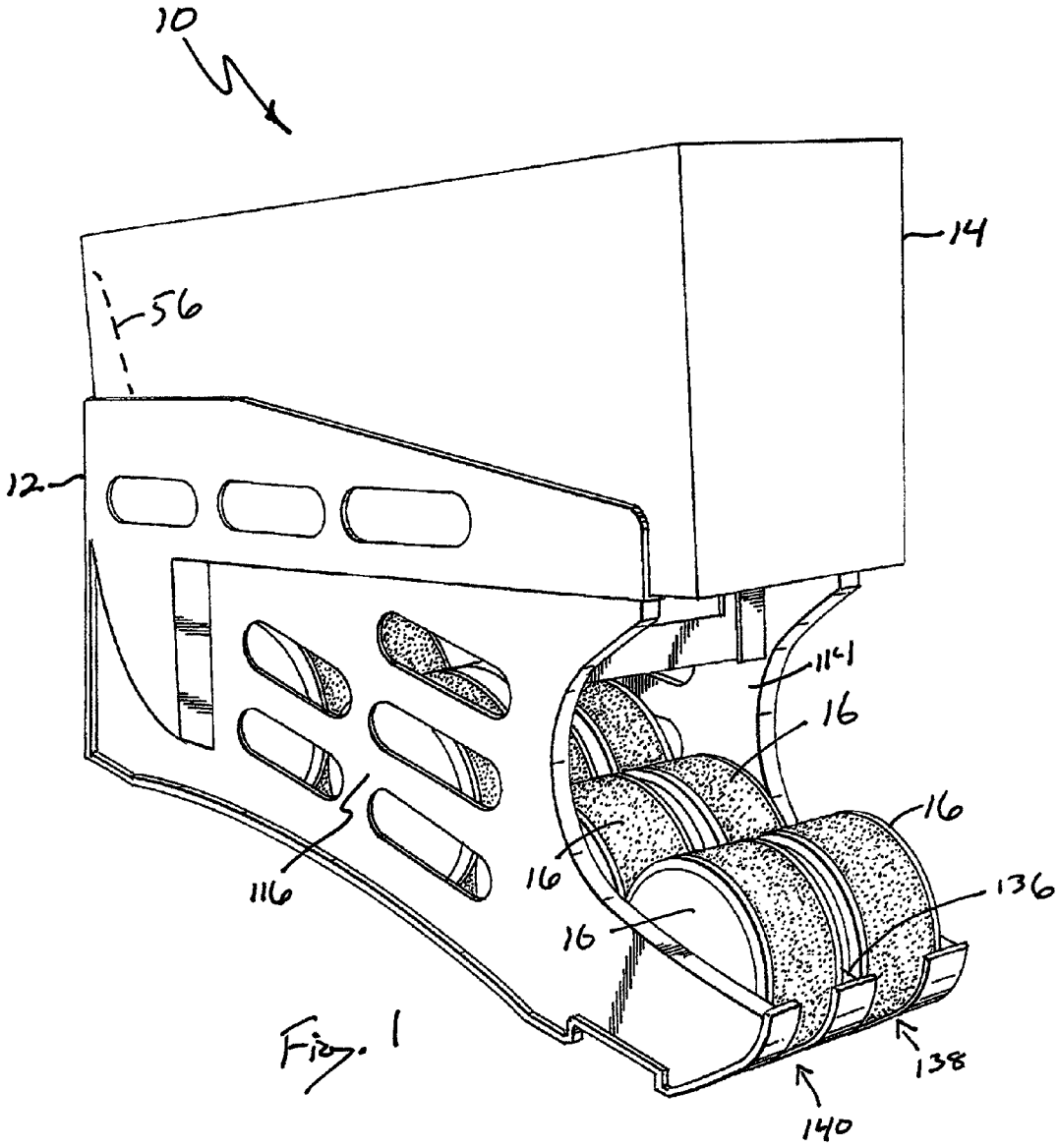
FIG. 1 is a front and side perspective view of one aspect of the disclosed product dispensing system with directional flexing.

Referring to FIG. 1, one aspect of the disclosed product dispensing system with directional flexing, generally designated 10, may include a dispenser 12 and a container 14. The container 14 may house multiple units of product 16, such as cans (e.g., canned food), jars (e.g., jarred sauce) or bottles (e.g., bottled soft drinks). As the container 14 is loaded onto the dispenser 12 by urging the container 14 horizontally along the dispenser 12, the dispenser 12 may open and engage the container 14, thereby releasing the products 16 from the container 14 into the dispenser 12.

The container 14 may be any container capable of housing products 16 and beneficially interacting with the disclosed dispenser 12 to release the products 16 to the dispenser 12. For example, the container 14 may be a paperboard carton or a corrugated box. Optionally, at least one major surface of the container 14 may be marked with various indicia, such as printed text and graphics.

Figure 2:
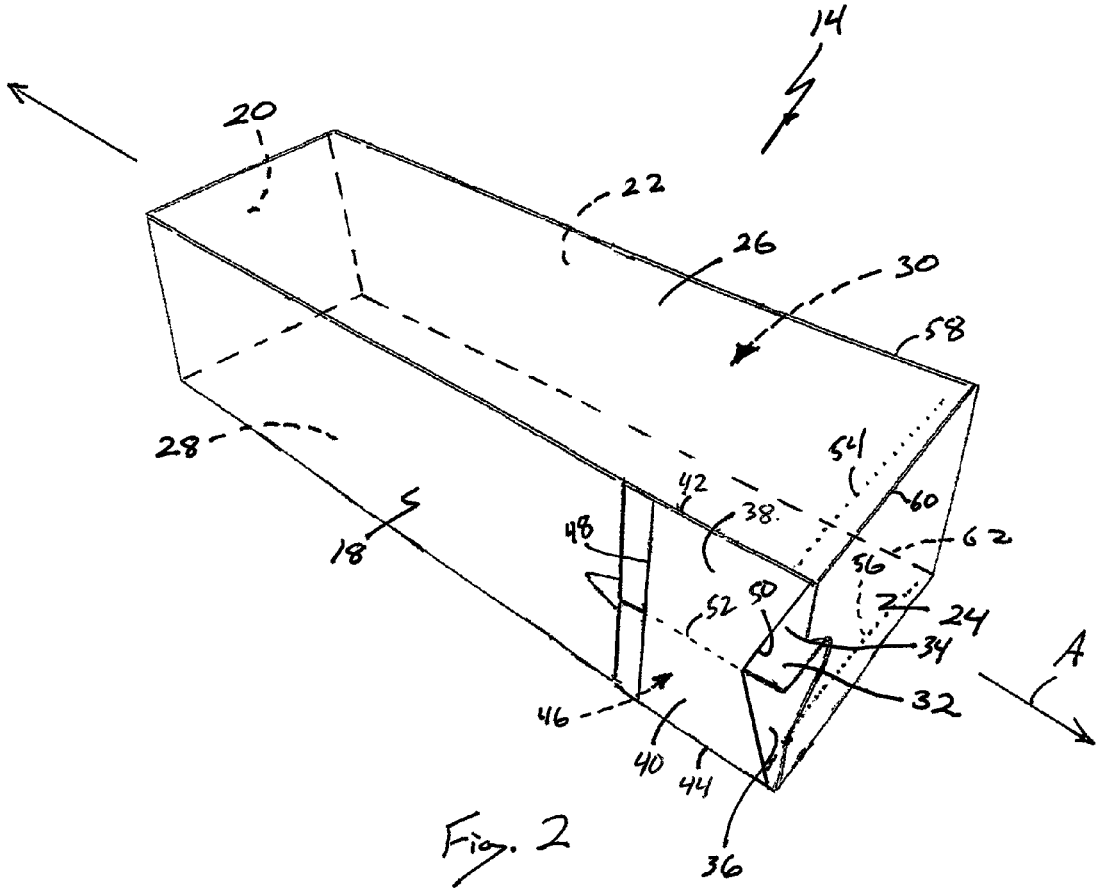
FIG. 2 is a rear and bottom perspective view of the container of the product dispensing system of FIG. 1.

As shown in FIG. 2, in one particular construction, the container 14 may be a generally rectilinear container having six walls 18, 20, 22, 24, 26, 28 that define an internal volume 30 for receiving the products 16. Opposed walls 20 and 24 may define the front and rear walls, respectively, of the container 14. Opposed walls 26 and 28 may define the first (e.g., right) and second (e.g., left) side walls, respectively, of the container 14. Opposed walls 18 and 22 may define the base and upper walls, respectively, of the container 14.

Optionally, the container 14 may include a partition 32 extending therethrough to divide the internal volume 30 into a first chamber 34 and a second chamber 36. The partition 32 may be a generally planar structure that is generally parallel with, but spaced apart from, the right 26 and left 28 side walls. Therefore, a first quantity of product 16 may be housed in the first chamber 34 and a second quantity of product 16 may be housing in the second chamber 36.

The base wall 18 of the container 14 may define one or more door flaps 38, 40. The door flaps 38, 40 may be defined by a forward edge 48 laterally extending between the side walls 26, 28, a rear edge 50 laterally extending between the side walls 26, 28, and a weakened severance line 52 extending between the forward edge 48 and the rear edge 50. As an example, the weakened severance line 52 may be formed as a row of perforations, and may extend from proximate (i.e., at or near) the forward edge 48 to proximate the rear edge 50.

Figure 3:
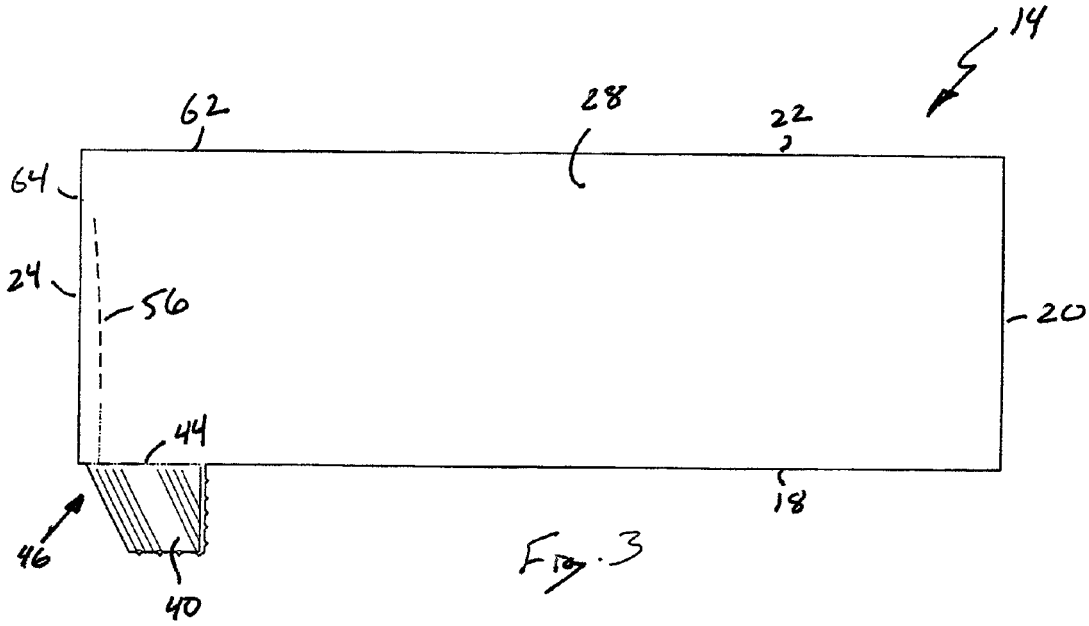
FIG. 3 is a side elevational view of the container of FIG. 2, shown in an open configuration.
Figure 4:
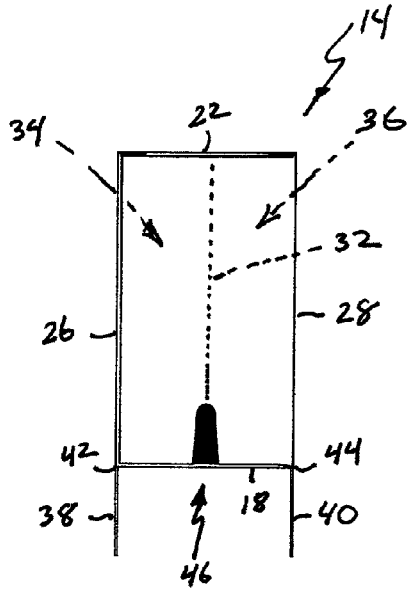
FIG. 4 is a rear elevational view of the container of FIG. 3.

As shown in FIGS. 3 and 4, when the weakened severance line 52 is severed, the door flaps 38, 40 may pivot laterally outward (i.e., toward the side walls 26, 28) along the edges 42, 44 between the base wall 18 and the side walls 26, 28, thereby forming an opening 46 in the container 14 that provides access to the internal volume 30, and through which the products 16 may exit the container 14. In one implementation, the door flaps 38, 40 may be formed prior to loading the container 14 onto the dispenser 12. In another implementation, the door flaps 38, 40 may be formed as the container 14 is loaded onto the dispenser 12, as described in greater detail herein.

Referring to FIGS. 2 and 3, the container 14 may be provided with pre-formed flex lines 54, 56 to encourage controlled flexing of the container 14 as the container 14 is compressed along its longitudinal axis A (FIG. 2). The pre-formed flex lines 54, 56 may be formed by weakening the container 14 along the pre-formed flex lines 54, 56. Examples of weakening techniques useful in forming the pre-formed flex lines 54, 56 include scoring the container 14, creasing the container 14 and forming perforations in the container 14.

As shown in FIG. 2, the pre-formed flex line 54 may be formed in the right side wall 26 of the container 14 proximate the rear wall 24. The pre-formed flex line 54 may extend upward from proximate the edge 42 (i.e., toward the edge 58 between the right side wall 26 and the upper wall 22). As one example, the pre-formed flex line 54 may extend upward from the edge 42, and may curve slightly toward the edge 60 (i.e., the edge between the right side wall 26 and the rear wall 24). As another example, the pre-formed flex line 54 may extend upward from the edge 42, and may be generally parallel with the edge 60.

As shown in FIG. 3, the pre-formed flex line 56 may be formed in the left side wall 28 of the container 14 proximate the rear wall 24. The pre-formed flex line 56 may extend upward from proximate the edge 44 (i.e., toward the edge 62 between the left side wall 28 and the upper wall 22). Like the pre-formed flex line 54, the pre-formed flex line 56 may extend upward from the edge 44, and may curve slightly toward the edge 64 (i.e., the edge between the left side wall 28 and the rear wall 24), or may be generally parallel with the edge 64. Those skilled in the art will appreciate that the position and shape of the pre-formed flex line 56 may closely correspond to the position and shape of the pre-formed flex line 54 such that generally symmetrical flexing of the container 14 is achieved under compression.

Figure 5:
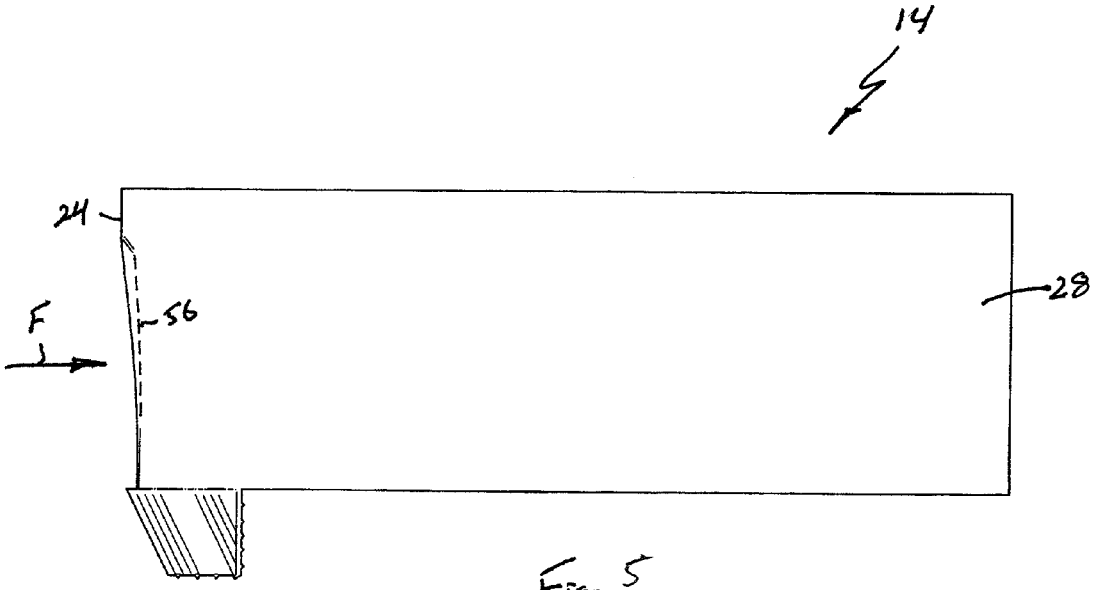
FIG. 5 is a side elevational view of the container of FIG. 2 shown in an open and fully engaged, flexed configuration.
Figure 6:
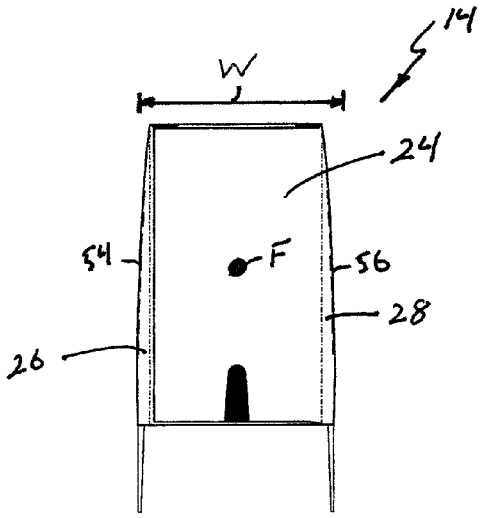
FIG. 6 is a rear elevational view of the container of FIG. 5.

Referring to FIGS. 5 and 6, when a longitudinal compression force F is applied to the rear wall 24 of the container 14, such as when the container 14 in loaded into engagement with the dispenser 12 (FIG. 1), the container 14 may flex along the pre-formed flex lines 54, 56. As the container 14 flexes along the pre-formed flex lines 54, 56, the side walls 26, 28 of the container 14 may bow outward, thereby increasing the lateral width W of the container 14 proximate the rear wall 24, as shown in FIG. 6 (in contrast to FIG. 4).

Without being limited to any particular theory, it is believed that increasing the lateral width W of the container 14 proximate the rear wall 24 may improve the movement of products 16 from the container 14, through the opening 46 (FIG. 4), and to the dispenser 12, thereby reducing the risk of products 16 jamming in the container 14.

As shown in FIG. 5, when the pre-formed flex lines 54, 56 are provided with a slight curvature (as described above), the rear wall 24 may become curved when the container 14 is flexed. It is believed that such a curved rear wall 24 may further improve movement of products 16 from the container 14 by guiding the products 16 to the opening 46 (FIG. 4).

Figure 7:
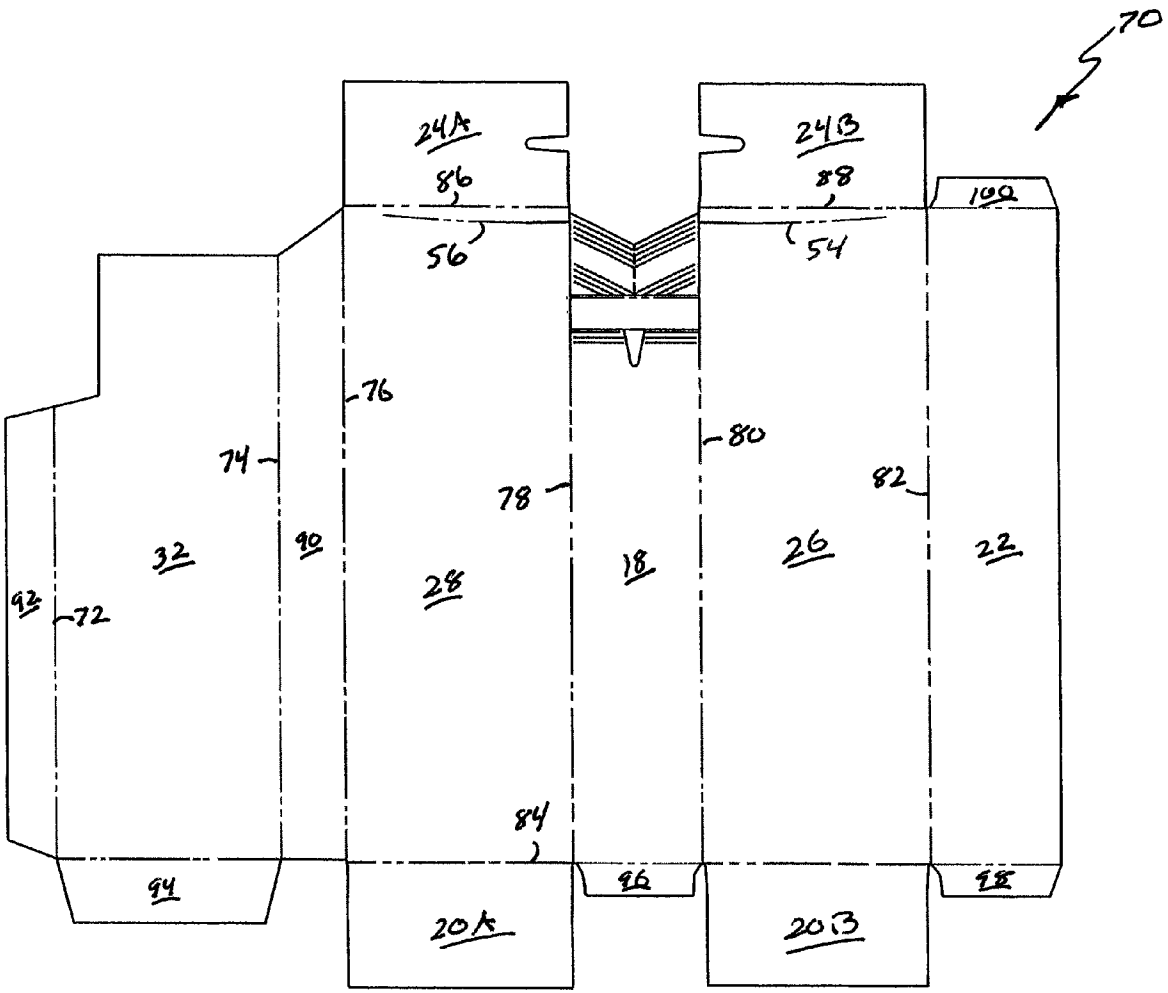
FIG. 7 is a top plan view of a container blank that may be used to form the container of FIG. 2.

The container 14 may be formed from a paperboard container blank, such as the paperboard container blank 70 shown in FIG. 7. The container blank 70 may include a plurality of pre-formed fold lines 72, 74, 76, 78, 80, 82, 84, 86, 88 that define the base wall 18, the front wall 20 (comprised of front wall panels 20A and 20B), the upper wall 22, the rear wall 24 (comprised of rear wall panels 24A and 24B), the right side wall 26, the left side wall 28, the partition 32, a transition panel 90 and sealing flaps 92, 94, 96, 98, 100.

The container 14 may be assembled by folding the container blank 70 along the longitudinal fold lines 72, 74, 76, 78, 80, 82 and connecting the upper wall 22 to the transition panel 90 to form the three-dimensional body of the container 14. Additionally, sealing flap 92 may be connected to the base wall 18 to secure the partition 32 between the side walls 26, 28 of the container 14. Then, the front wall panels 20A and 20B and sealing flaps 94, 96, 98 may be assembled to form the front wall 20 of the container 14 and the rear wall panels 24A and 24B and sealing flap 100 may be assembled to form the rear wall 24 of the container 14.

While a specific paperboard container blank 70 is shown and described, those skilled in the art will appreciate that various techniques and materials may be used to form the container 14. Folded paperboard containers are only one specific and non-limiting example of the container 14 of the disclosed product dispensing system with direction flexing 10.

Figure 8:
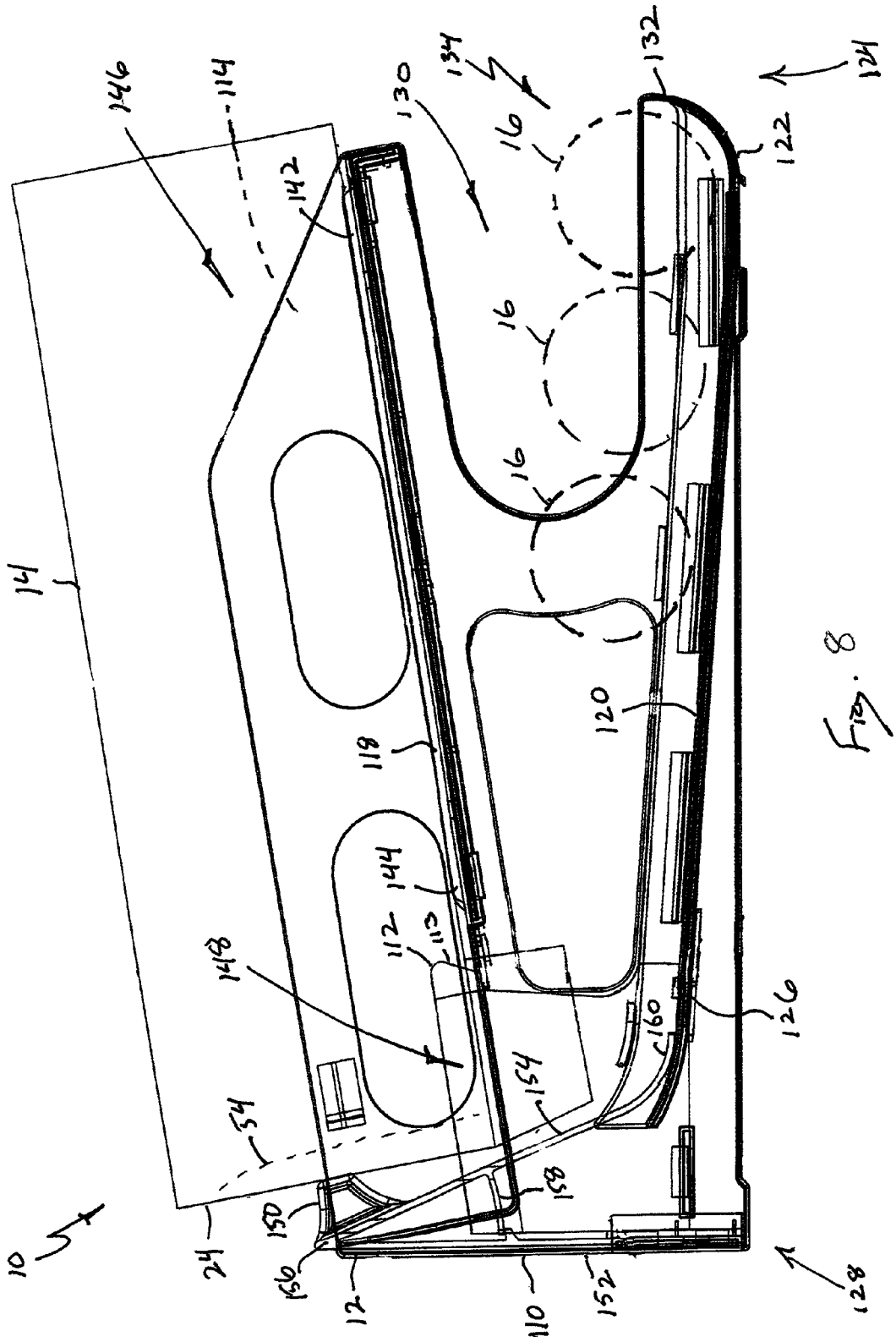
FIG. 8 is a side elevational view, in section, of the product dispensing system of FIG. 1, shown with the container partially engaged with the dispenser.

Referring to FIG. 8, the dispenser 12 may include a frame 110 and an opening tool 112. The frame 110 of the dispenser 12 may support the container 14 in a desired configuration and may provide the compression force F (FIG. 5) required to flex the container 14 along the pre-formed flex lines 54, 56. The opening tool 112 may sever the weakened severance line 52 (FIG. 2) to form the door flaps 38, 40 and, ultimately, the opening 46, as the container 14 is loaded onto the frame 60 of the dispenser 12, thereby releasing the products 16 from the container 14 to the dispenser 12.

Those skilled in the art will appreciate that the dispenser 12 may include additional components and features, such as one or more of the components and features of the dispensers disclosed in U.S. Ser. No. 12/777,444, without departing from the scope of the present disclosure.

The frame 110 may include a first (e.g., right) side wall 114, a second (e.g., left) side wall 116 (FIG. 1), an upper support deck 118 and a lower support deck 120. The right side wall 114 may be laterally spaced from the left side wall 116, and may be generally parallel with the left side wall 116.

The lower support deck 120 may laterally extend between the right 114 and left 116 side walls, and may include a front end 122 that longitudinally extends toward the front end 124 of the frame 110 and a rear end 126 that longitudinally extends toward the rear end 128 of the frame 110. Therefore, the lower support deck 120 and the side walls 114, 116 may define a lower level 130 of the frame 110.

The lower support deck 120 may be inclined from the front end 122 to the rear end 126 (i.e., the rear end 126 may be elevated relative to the front end 122) such that products 16 deposited proximate the rear end 126 of the lower support deck 120 roll down to the front end 122 of the lower support deck 120 under the force of gravity. The extent of the incline of the lower support deck 120 may be dictated by, among other things, the coefficient of friction of the material used to form the frame 110 and the shape of the products 16 to be dispensed by the dispenser 12.

One or more stops 132 may be positioned proximate the front end 122 of the lower support deck 120 to prevent products 16 from rolling beyond the front end 122 of the lower support deck 120. For example, the stops 132 may be connected to (e.g., integral with) the lower support deck 120, and may form an upward curve at the front end 122 of the lower support deck 120. Therefore, the stops 132 may collect products 16 at the front end 122 of the lower support deck 120, thereby defining a product display area 134 at the front end 122 of the lower support deck 120.

Referring to FIGS. 1 and 8, in one particular implementation, the frame 110 may include a divider 136 extending from the front end 122 of the lower support deck 120 to the rear end 126 of the lower support deck 120 to divide the lower level 130 into a first product channel 138 and a second product channel 140. The first product channel 138 may be defined by the lower support deck 120, the right side wall 114 and the divider 136, and may extend from proximate the rear end 126 of the lower support deck 120 to the front end 122 of the lower support deck 120. The second product channel 140 may be defined by the lower support deck 120, the left side wall 116 and the divider 136, and may extend from proximate the rear end 126 of the lower support deck 120 to the front end 122 of the lower support deck 120. While two product channels 138, 140 are shown and described, those skilled in the art will appreciate that the frame 110 may be constructed to provide only one product channel or more than two product channels, without departing from the scope of the present disclosure.

The upper support deck 118 may laterally extend between the right 114 and left 116 side walls, and may include a front end 142 that longitudinally extends toward the front end 124 of the frame 110 and a rear end 144 that longitudinally extends toward, but not to, the rear end 128 of the frame 110. Therefore, the upper support deck 118 and the side walls 114, 116 may define an upper level 146 of the frame 110.

The spacing between the rear end 144 of the upper support deck 118 and the rear end 128 of the frame 110 may define an opening 148, which may function as a chute to allow products 16 to move from the upper level 146 to the lower level 130 of the frame 110.

The upper support deck 118 may be declined from the front end 142 to the rear end 144 (i.e., the front end 142 may be elevated relative to the rear end 144). Therefore, products 16 supported by the upper support deck 118 may roll under the force of gravity down to the rear end 144 of the upper support deck 118, through the opening 148, to the lower level 130 of the frame 110 and, ultimately, to the product display area 134.

Figure 9:
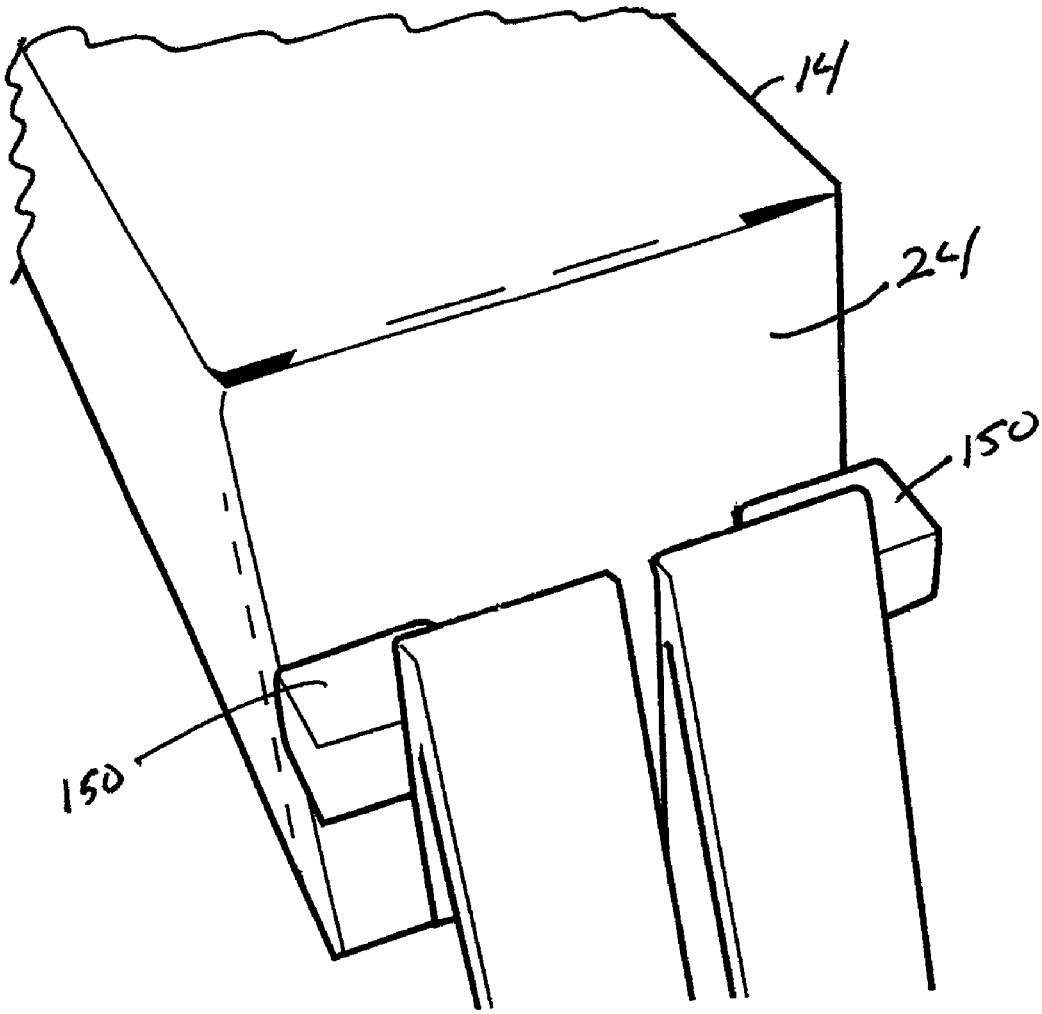
FIG. 9 is a rear perspective view of a portion of the product dispensing system of FIG. 8.

A stop 150 may be supported in the upper level 146 of the frame 110 proximate the rear end 128 of the frame 110. As shown in greater detail in FIG. 9, the rear stop 150 may be positioned to engage the rear wall 24 of the container 14 as the container 14 is horizontally urged along the upper support deck 118, thereby inhibiting further rearward horizontal movement of the container 14 beyond the stop 150. Those skilled in the art will appreciate that the rear stop 150 may be positioned at various locations (e.g., centered) relative to the rear wall 24 of the container 14, and that the rear stop 150 may have various sizes and shapes relative to the rear wall 24 of the container 14, provided that the rear stop 150 is sufficient to supply the reactive, flexing force F (FIG. 5) to the rear wall 24 of the container 14.

Figure 10:
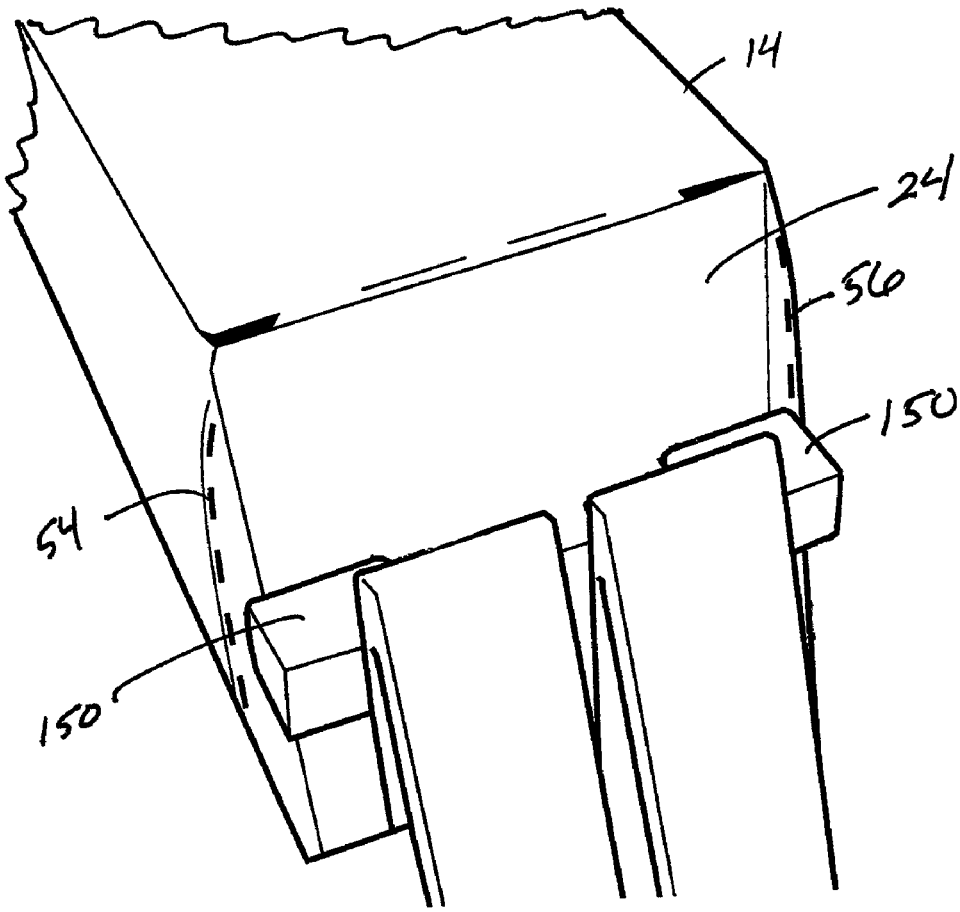
FIG. 10 is a rear perspective view of the product dispensing system of FIG. 9 shown with the container in a fully engaged and flexed configuration.

Thus, as shown in FIG. 10, the engagement between the rear wall 24 of the container 14 and the rear stop 150 may supply the force F (FIG. 5) required to flex the container 14 along the pre-formed flex lines 54, 56.

Referring back to FIG. 8, an optional rear wall 152 may be positioned at the rear end 128 of the frame 110 between the right 114 and left 116 side walls. The rear wall 152 may structurally reinforce the rear stop 150, and may support the rear stop 150 at the desired location relative to the container 14.

A guide 154 may be connected to the rear wall 152 of the frame 110, and may extend through the opening 148 in the frame 110, from the upper level 146 to the lower level 130. The guide 154 may be positioned to receive products 16 exiting the opening 46 in the container 14 and passing through the opening 148 in the frame 110, and may guide the products 16 to the rear end 126 of the lower support deck 120.

Optionally, the guide 154 may be springingly connected to the rear wall 152 of the frame 110 at a connection point 156, and may include a protrusion 158 extending toward the rear wall 152. As a product 16 drops into engagement with the receiving end 160 of the guide 154, the force of the product 16 acting on the guide 154 may urge the guide 154, and specifically the protrusion 158, into engagement with the rear wall 152. Therefore, as the guide 154 receives a product 16, the guide 154 may effect a "tapping" of the rear wall 152. The vibration of the "tapping" may be transferred throughout the system 10, including the products 16 remaining in the container 14, thereby encouraging products 16 to move from the container 14 to the dispenser 12. As the product 16 disengages the guide 154 and moves toward the product display area 134, the spring-loaded guide 154 may return to its original position (FIG. 8) to await another dispensing product 16.

The opening tool 112 may extend into the upper level 146 of the frame 110 to sever the weakened severance line 52 (FIG. 2) of the container 14 as the container 14 is horizontally urged along the upper support deck 118 of the frame 110. The type of opening tool 112 used, as well as the position of the opening tool 112, are design considerations, and may be selected such that the opening tool 112 is capable of opening the container 14 (e.g., severing the weakened severance line 52), but creates little or no interference with the movement of the container 14 along the upper support deck 118.

In one particular construction, the opening tool 112 may include a forward cutting edge 113 positioned (e.g., centered) between the side walls 114, 116 of the frame 110 proximate the rear end 144 of the upper support deck 118. Therefore, the opening tool 112 may sever the weakened severance line 52 (FIG. 2) and may form the door flaps 38, 40 just prior to the separated door flaps 38, 40 reaching the opening 148 in the frame 110 (i.e., the opening 148 between the upper 146 and lower 130 levels of the frame 110).

Accordingly, as the container 14 is urged horizontally along the upper support deck 118 of the dispenser frame 110, the opening tool 112 may automatically open the container 14 and the engagement between the rear stop 150 of the dispenser 12 and the rear wall 24 of the container 14 may cause controlled and beneficial flexing of the container 14 along the pre-formed flex lines 54, 56, thereby releasing the products 16 from the container 14, down to the lower level 130 of the dispenser frame 110 and, ultimately, to the product display area 134 of the dispenser 12.

Although various aspects of the disclosed product dispensing system with directional flexing container have been shown and described, modifications may occur to those skilled in the art upon reading the specification. The present application includes such modifications and is limited only by the scope of the claims.

What is claimed is:

1. A product dispensing system comprising:

a container comprising a plurality of walls that define an internal volume, at least one side wall of said plurality of walls comprising a pre-formed flex line; and a dispenser comprising:

a frame having a front end and a rear end, said frame comprising a stop projecting from said rear end and a support deck extending between said front end and said rear end, and a lower support deck extending between said front end and said rear end, said lower support deck defining a product display area proximate said front end; and an opening tool positioned to create an opening in said container as said container is moved along said support deck from said front end toward said stop, such that at least one product in said container is dispensed through said opening to said product display area, wherein said container flexes along said pre-formed flex line when said container engages said stop, thus flexing said at least one side wall outward to ease the passage of said at least one product.

2. The product dispensing system of claim 1 wherein said plurality of walls comprises a base wall that defines door flaps connected by a weakened severance line, and wherein said opening tool severs said weakened severance line as said container is moved along said support deck toward said stop.

3. The product dispensing system of claim 1 further comprising a plurality of products in said internal volume.

4. The product dispensing system of claim 1 wherein said container comprises paperboard.

5. The product dispensing system of claim 1 wherein said pre-formed flex line comprises perforations.

6. The product dispensing system of claim 1 wherein said pre-formed flex line comprises a cease.

7. The product dispensing system of claim 1 wherein said plurality of walls comprises a rear wall.

8. The product dispensing system of claim 7 wherein said pre-formed flex line is formed proximate said rear wall.

9. The product dispensing system of claim 7 wherein said pre-formed flex line curves toward said rear wall.

10. The product dispensing system of claim 7 wherein said container flexes along said pre-formed flex line when said rear wall engages said stop.

11. The product dispensing system of claim 1 wherein said plurality of walls comprises a rear wall, a first side wall and a second side wall, said second side wall being laterally opposed from said first side wall, and wherein a first pre-formed flex line is formed in said first side wall and a second pre-formed flex line is formed in said second side wall.

12. The product dispensing system of claim 11 wherein said first and said second pre-formed flex line are formed proximate said rear wall.

13. The product dispensing system of claim 11 wherein said first and said second pre-formed flex lines curve toward said rear wall.

* * * * *